US011369153B2

(12) United States Patent
Thompson

(10) Patent No.: US 11,369,153 B2
(45) Date of Patent: Jun. 28, 2022

(54) WEARABLE VISIBILITY SYSTEM

(71) Applicant: Samuel Thompson, Vancouver, WA (US)

(72) Inventor: Samuel Thompson, Vancouver, WA (US)

(73) Assignee: Samuel Thompson, Vancouver, WA (US)

( * ) Notice: Subject to any disclaimer, the term of this patent is extended or adjusted under 35 U.S.C. 154(b) by 0 days.

(21) Appl. No.: 17/342,425

(22) Filed: Jun. 8, 2021

(65) Prior Publication Data

US 2022/0125131 A1 Apr. 28, 2022

Related U.S. Application Data

(63) Continuation of application No. 16/457,247, filed on Jun. 28, 2019, now abandoned.

(51) Int. Cl.

| | |
|---|---|
| ***A41D 13/01*** | (2006.01) |
| ***F21V 33/00*** | (2006.01) |
| ***G08B 5/00*** | (2006.01) |
| ***F21Y 115/10*** | (2016.01) |

(52) U.S. Cl.

CPC ..... *A41D 13/01* (2013.01); *F21V 33/0008* (2013.01); *G08B 5/004* (2013.01); *F21Y 2115/10* (2016.08)

(58) Field of Classification Search

CPC . A41D 13/01; F21V 33/0008; F21Y 2115/10; G08B 5/004

See application file for complete search history.

(56) References Cited

U.S. PATENT DOCUMENTS

| | | | | |
|---|---|---|---|---|
| 5,381,318 | A | 1/1995 | Fang | |
| 6,106,130 | A | 8/2000 | Harding | |
| 7,011,427 | B1 * | 3/2006 | Baez | G08B 5/004 362/205 |
| 7,210,605 | B2 | 5/2007 | Willows et al. | |
| 7,377,663 | B2 | 5/2008 | Desjardin | |
| 2016/0353813 | A1 * | 12/2016 | Rae | A41D 13/01 |

* cited by examiner

*Primary Examiner* — Jason M Han

(74) *Attorney, Agent, or Firm* — Perkins Coie LLP

(57) ABSTRACT

The present technology is directed to wearable visibility systems that can comprises a base strap, a light assembly carried directly or indirectly to the base strap, and a power source container carried by the base strap. The base strap has a front portion, a rear portion, and a shoulder portion between the front portion and the rear portion. The base strap is flexible and configured such that the shoulder portion is configured to conform to a shoulder of a person. The light assembly includes one or more light sources and is configured to extend along at least a portion of each of the front portion and rear portion of the base strap. The power source container is electrically coupled to the light assembly.

11 Claims, 6 Drawing Sheets

WEARABLE VISIBILITY SYSTEM

CROSS-REFERENCE TO RELATED APPLICATION

This application is a continuation of U.S. patent application Ser. No. 16/457,247 filed on Jun. 28, 2019, which is hereby incorporated by reference in its entirety.

TECHNICAL FIELD

The present technology is directed to wearable systems that have lights to enhance visibility of the person wearing the systems.

BACKGROUND

Many people walk, run, ride bicycles, ride scooters and/or ride boards (e.g., motorized and self-propelled) for exercise or transportation in low light or low visibility settings. For example, many people walk or run for exercise early in the morning before work or at night after work. Similarly, many people commute on bicycles (self-propelled or e-bikes) or e-scooters, and it is very common that they ride in city traffic and/or when it is dark outside. As a result, these simple and enjoyable activities can be dangerous because car and truck drivers may not see such pedestrians or riders. This is particularly the case in city environments where car and truck drivers are concentrating on other motorized vehicles, traffic lights, bus lanes, etc. Therefore, there is a need to enhance the safety of pedestrians and riders.

DETAILED DESCRIPTION

Several embodiments of the present technology are directed toward external wearable systems that cross over the front and back portion of the torso of a person and have lights coupled to a portable power source. The wearable visibility systems are comfortably worn over one or both shoulders and provide enhanced visibility for pedestrians and riders. Additionally, the wearable visibility systems are comfortable and maneuverable so that they do not impact or otherwise impair physical activity.

Figure 1A:
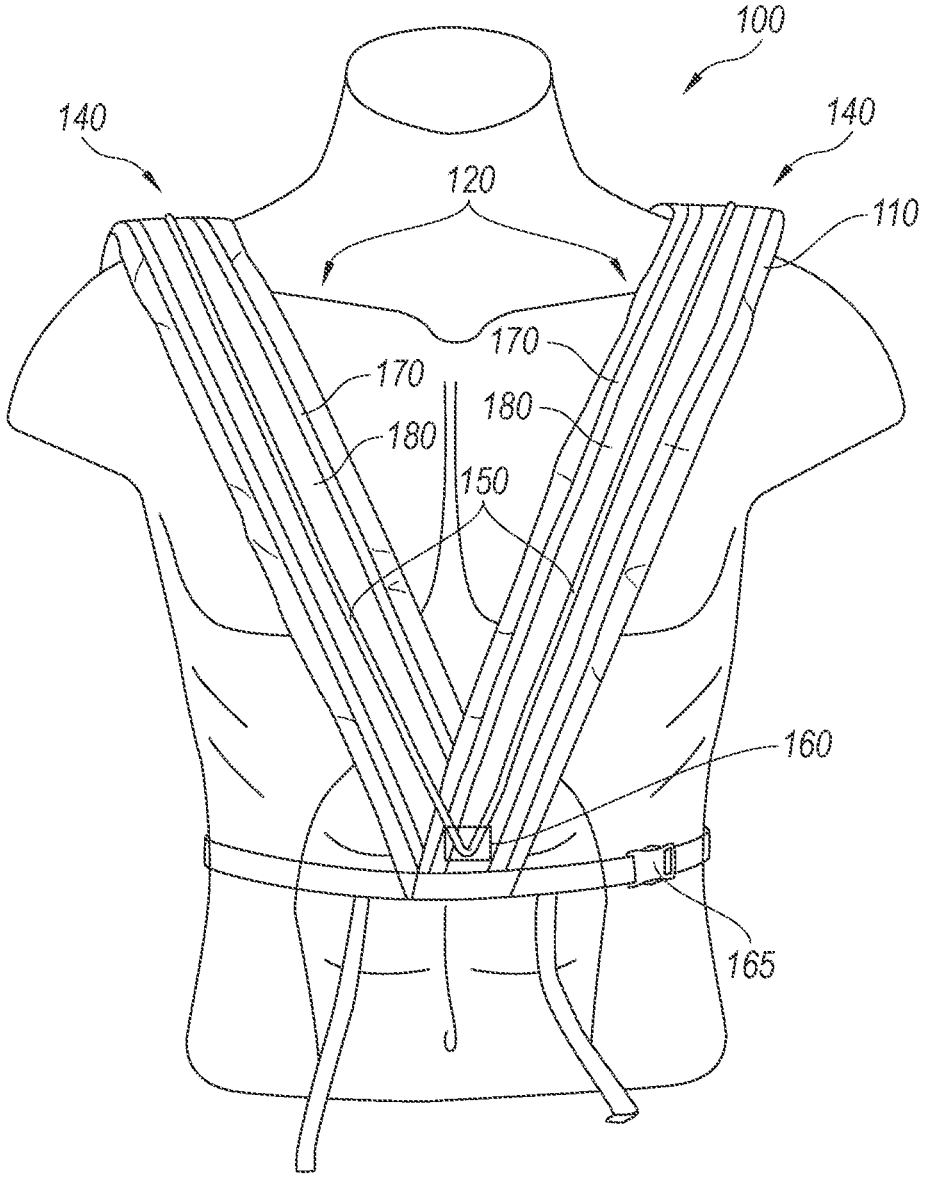
FIG. 1A is a front view of a wearable visibility system in accordance with the present technology as worn by a person.
Figure 1B:
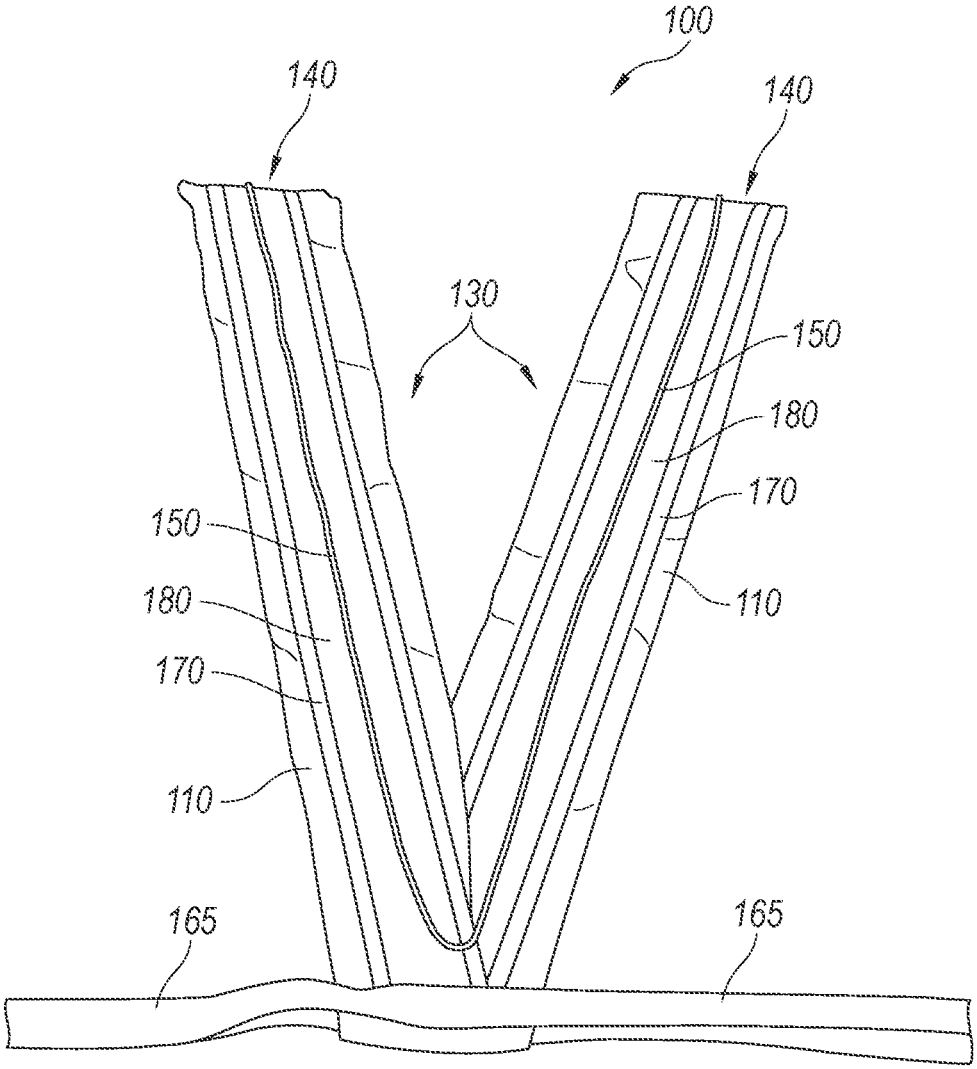
FIG. 1B is a back view of the wearable visibility system of FIG. 1A in accordance with the present technology.

FIG. 1A is a front view of a wearable visibility system 100, and FIG. 1B is a back view of the wearable visibility system 100. Referring to FIGS. 1A-B together, the wearable visibility system 100 can include base strap 110 with a front portion 120 (FIG. 1A), a rear portion 130 (FIG. 1B), and a shoulder portion 140 between the front portion 120 and the rear portion 130. The base strap 110 is flexible and configured such that the shoulder portion 140 conforms to the shoulders of a person. The base strap 110 can be made from a durable, flexible material, such as Grosgrain. The wearable visibility system 110 further includes a light assembly 150 having a plurality of lights extending along at least sections of the front portion 120 and the rear portion 130 of the base strap 110. The wearable visibility system 110 can also include a power source container 160 (Shown schematically in FIGS. 1A and 2) attached to or otherwise carried by the base strap 110, and a belt 165 attached to the base strap 110 that is configured to be buckled around a user's waist area. The power source container 160 can have contacts or other types of electrical connectors electrically coupled to the light assembly 150. The power source container 160 can be configured to hold one or more disposable, replaceable batteries (e.g., AA or AAA batteries), or the power source container 160 can hold a permanent rechargeable battery.

The light assembly 150 can be a light rope have several individual lights electrically coupled in a string. The lights in the light assembly 150, for example, can be LEDs or other suitable lights. The light assembly 150 can alternatively be a flexible light tube with a single light source or multiple light sources. The light assembly 150 can extend along only the front and rear portions 120 and 130, or the light assembly 150 can extend continuously along the complete lengths of the front portion 120, rear portion 130, and the shoulder portion 140.

The wearable visibility system 100 can optionally include an attachment medium 170 attached to the base strap 110 and a reflective material 180 attached to the attachment medium 170. The attachment medium 170 can be felt, flexibly foam, or another suitable material that can be adhered (e.g., glued and/or taped) and/or stitched to the base strap 110 to provide a substrate to which the light assembly 150 can be readily stitched or otherwise adhered (e.g., glued and/or taped). The reflective material 180 can be adhered and/or stitched directly to the attachment medium 170. The wearable visibility system 100 can alternatively exclude one or both of the attachment medium 170 or the reflective material 180. For example, the wearable visibility system 100 can exclude the attachment medium 170 such that the reflective material 180 is attached directly to the base strap 110 and the light assembly 150 is attached directly to either the base strap 110 or the reflective material 170. In another example, both the attachment assembly 170 and the reflective material 180 are excluded such that the light assembly 150 is attached directly to the base strap 110.

Figure 2:
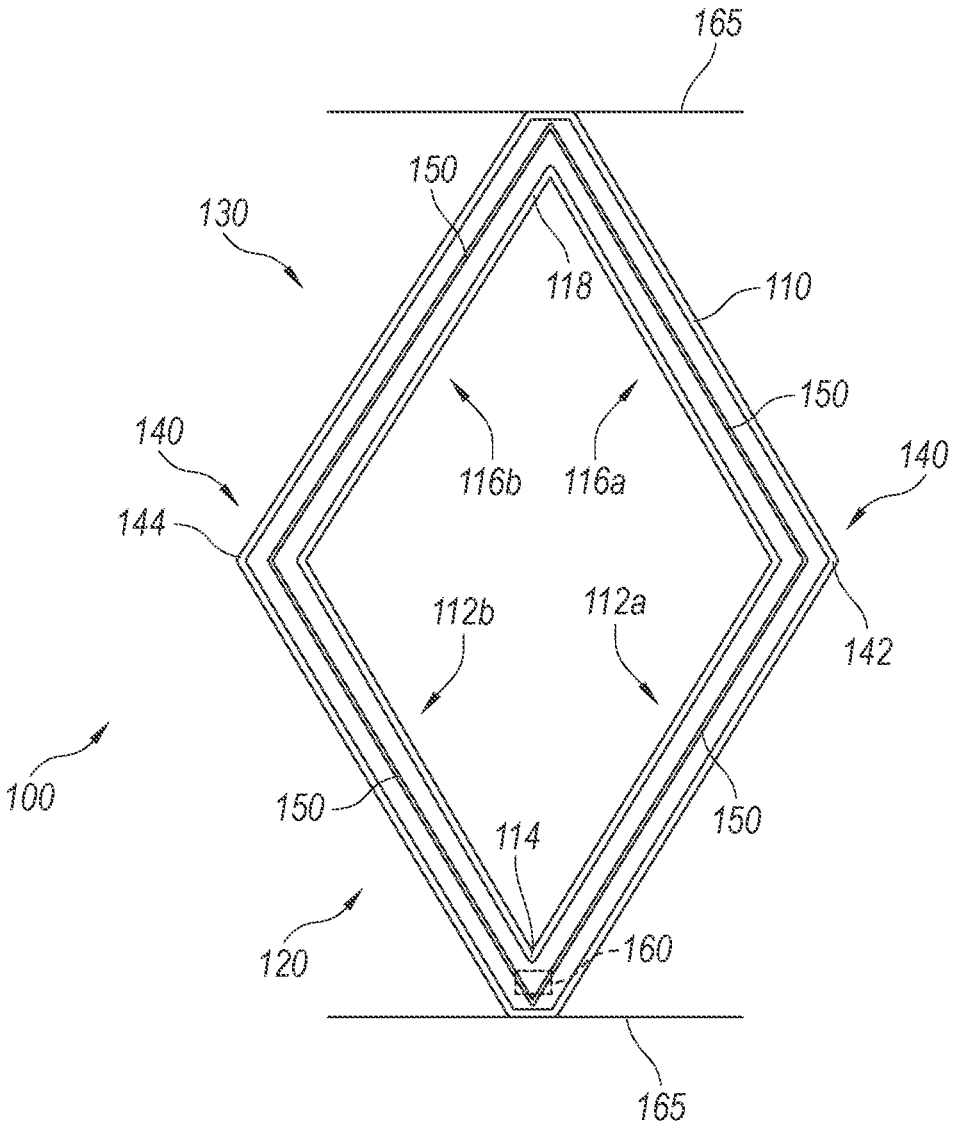
FIG. 2 is a top view of the wearable visibility system of FIGS. 1A-B in a flat state.

FIG. 2 is a top view of the wearable visibility system 100 in a flat state. Like reference numbers refer to like components in FIGS. 1A-2. The base strap 110 has a diamond-shape in the flat state such that the front portion 120 of the base strap 110 has a V-shape with a left front section 112*a* (from the user's perspective), a right front section 112*b*, and a front apex 114 where the left front section 112*a* meets the right front section 112*b*. The rear portion 130 of the base strap 110 has a V-shape with a left rear section 116*a* (from the user's perspective), a right rear section 116*b*, and a rear apex 118 where the left rear portion 116*a* meets the right rear portion 116*b*. The front apex 114 extends in a first direction and the rear apex 118 extends in a second direction opposite the first direction. The shoulder portion 140 of the base strap 110 has a left shoulder portion 142 where the left front section 112*a* meets the left rear section 116*a*, and a right shoulder portion 144 where the right front section 112*b* meets the right rear section 116*b*.

Figure 3A:
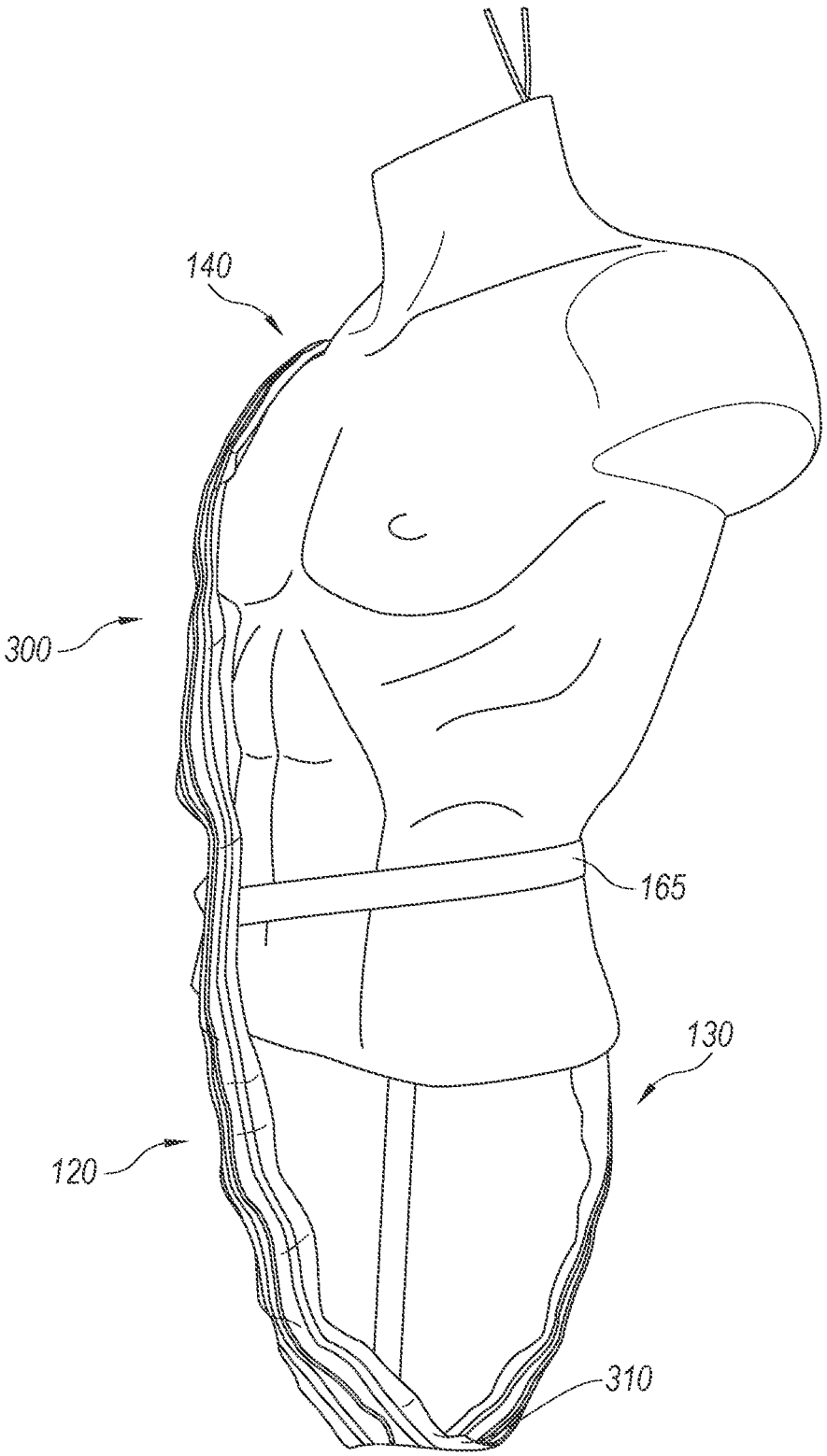
FIG. 3A is a side view of a wearable visibility system in accordance with the present technology as worn by a person.
Figure 3B:
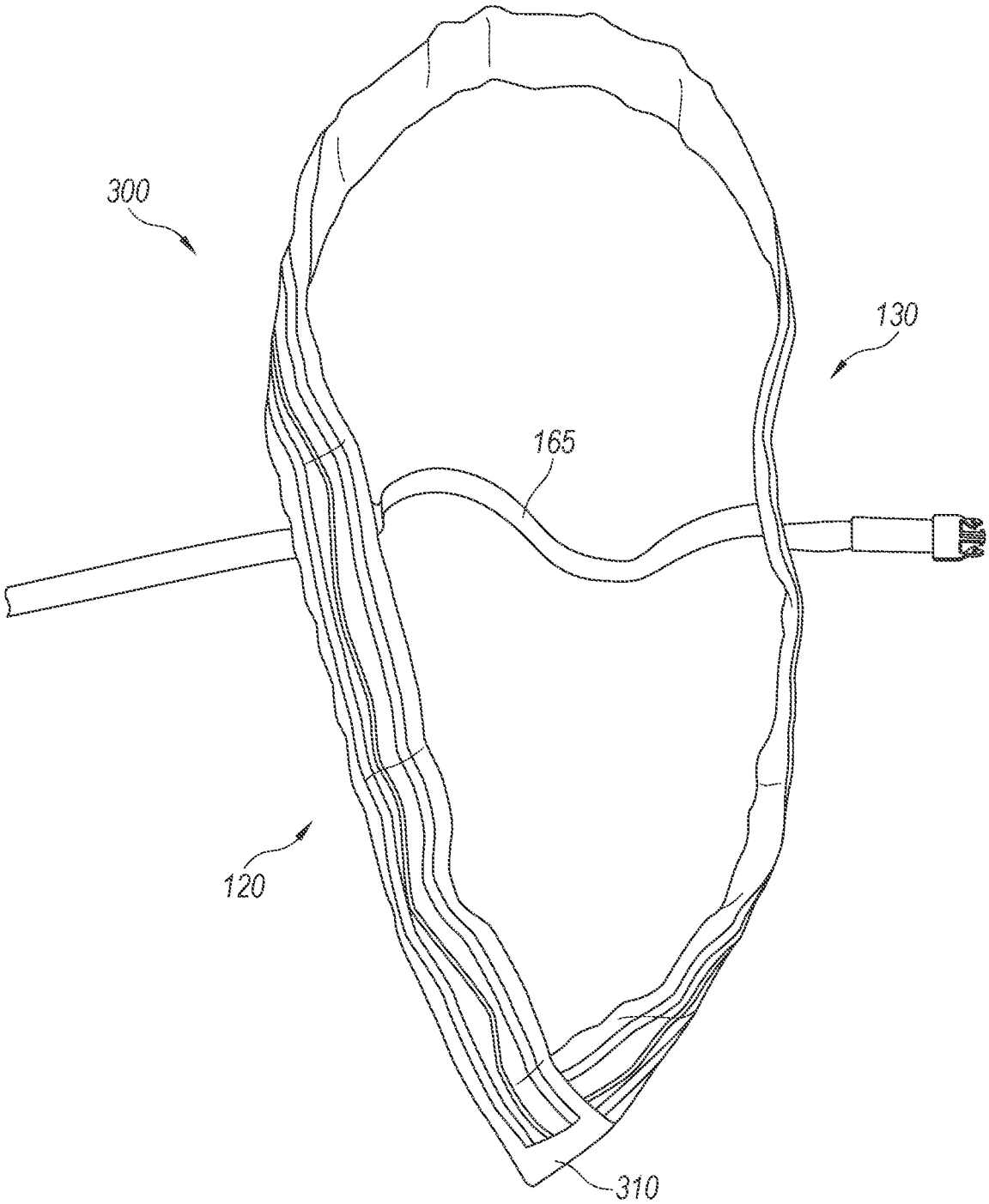
FIG. 3B is a top view of the wearable visibility system of FIG. 3A.

FIG. 3A is a side view of another embodiment of a wearable visibility system 300 and FIG. 3B is a top view of the wearable visibility system 300 shown in FIG. 3A. The embodiment of the wearable visibility system 300 shown in FIGS. 3A and 3B has many of the same components as the embodiment of the wearable visibility system 100 shown and described with reference to FIGS. 1A and 1B. As such, like reference numbers refer to like component in FIGS. 1A, 1B, 3A and 3B. Referring to FIGS. 3A and 3B together, the wearable visibility system 300 has an inverted tear drop shape with a single shoulder region 140 such that is worn as a sash over only one shoulder. The front and rear portions 120 and 130 of the wearable visibility system 300 accordingly extend from one shoulder to an opposite hip or side of the person, respectively. This is different than the diamond-shaped wearable visibility system 100 shown in FIGS. 1A and 1B in that the diamond-shaped visibility system 100 has two shoulder regions 142 and 144 (FIG. 2) that rest on both the left and right shoulders of the person. Additionally, the power source container 160 is attached to the V-shaped region 310 at the base of the wearable visibility system 300 as shown in FIG. 3B.

Figure 4A:
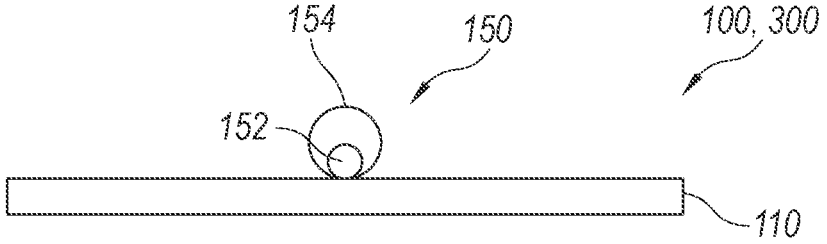
FIGS. 4A-4E are cross-sectional views of wearable visibility systems in accordance with the present technology.
Figure 4B:
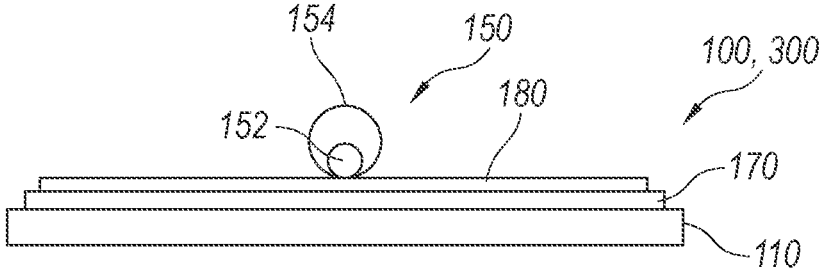
Figure 4C:
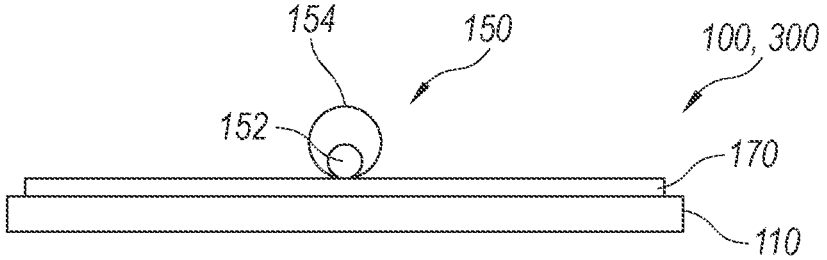
Figure 4D:
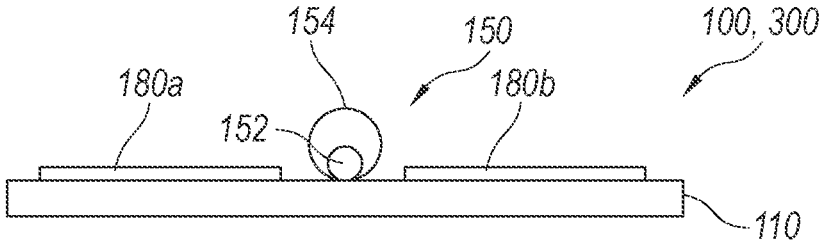
Figure 4E:
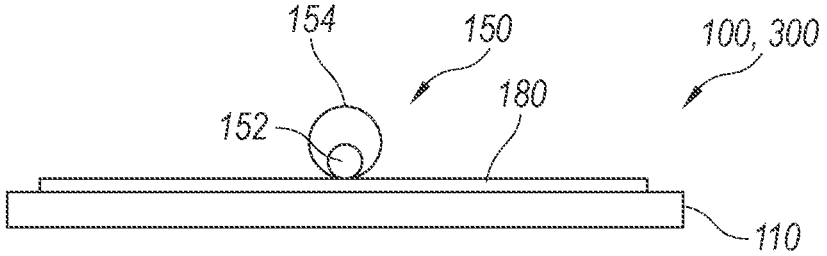

FIGS. 4A-4E are cross-sectional views of the wearable visibility systems 100 and 300 shown in FIGS. 1A-3B that show various combinations of the base strap 110, light assembly 150, attachment medium 170, and reflective material 180. Like reference numbers refer to like components in FIGS. 1A-4E. The light assembly 150 can be a light rope that includes one or more light source 152 (only one shown in FIGS. 4A-4E) and an outer sheath or tube 154 that further protects the light sources 152. Referring to FIG. 4A, the light assembly 150 can be attached directly to the base strap 110 by an adhesive (e.g., glue and/or tape) and/or stitching. This embodiment does not include the attachment medium 170 or the reflective material 180. Referring to FIG. 4B, the attachment medium 170 is attached directly to the base strap 110, the reflective material 180 is attached directly to the attachment medium 170, and the light assembly 150 is attached to the reflective material 180. This embodiment includes both the attachment medium 170 and the reflective material 180. Referring to FIG. 4C, the attachment medium 170 is attached directly to the base substrate 110 and the light assembly 150 is attached to the attachment medium 170. This embodiment does not include the reflective material 180. Referring to FIG. 4D, the light assembly 150 is attached directly to the base strap 110 and two strips of reflective material 180*a* and 180*b* are attached to the base strap 110 such that one strip of reflective material extends along each side of the light assembly 150. This embodiment does not include the attachment medium 170. Referring to FIG. 4E, a single strip of the reflective material 180 is attached to the base strap 110 and the light assembly 150 is attached to the reflective material 180 and optionally attached to the base strap 100 as well.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A wearable visibility system, comprising:

a base strap having a front portion, a rear portion, and a shoulder portion between the front portion and the rear portion, wherein the base strap is a flexible single over-the-shoulder sash in which the shoulder portion of the base strap is configured to be worn over a single shoulder of the person and the front portion is connected to the rear portion at a side apex configured to be located at a side of the person opposite the single shoulder;

an attachment medium defined by a substrate connected to the base strap;

a reflective material attached to the attachment medium;

a light assembly mounted to the reflective medium, the light assembly including a light tube having a plurality of lights extending along at least the front portion and rear portion of the base strap; and a power source container carried by the base strap and electrically coupled to the light assembly.

2. The wearable visibility system of claim 1 wherein the lights of the light assembly comprise LED lights.

3. The wearable visibility system of claim 1 wherein the base strap comprises a reflective material.

4. The wearable visibility system of claim 1, further comprising a belt attached to the front portion and the rear portion of the base strap.

5. The wearable visibility system of claim 4 wherein the belt has a quick-release buckle.

6. The wearable visibility system of claim 1 wherein the power source container has a positive contact and a negative contact, and the power source container is configured to hold a disposable, replaceable battery in electrical connection with the positive and the negative contact.

7. The wearable visibility system of claim 1, further comprising a rechargeable power source contained in the power source container.

8. A wearable visibility system, comprising:

a base strap having a front portion, a rear portion, and a shoulder portion between the front portion and the rear portion, wherein the base strap is flexible and configured such that the shoulder portion is configured to conform to a shoulder of a person;

an attachment medium defined by a substrate connected to the base strap;

a reflective material attached to the attachment medium;

a light assembly including a plurality of lights attached to the reflective medium and extending along at least the front portion and rear portion of the base strap; and a power source container carried by the base strap and electrically coupled to the light assembly;

wherein the base strap has a diamond shape when in a flat state such that the front portion of the base strap has a front V-shape with a left front section, a right front section, and a front apex where the left front section meets the right front section, and the rear portion of the base strap has a rear V-shape with a left rear section, a right rear section, and a rear apex where the left rear portion meets the right rear portion, and the front apex extends in a first direction and the rear apex extends in a second direction opposite the first direction;

wherein the shoulder portion of the base strap has a left shoulder portion where the left front section meets the left rear section and a right shoulder portion where the right front section meets the right rear section;

wherein the power source container is attached to the base strap at one of the front apex or the rear apex.

9. The wearable visibility system of claim 8 wherein the light tube extends along the left front section, left shoulder portion, left rear section, rear apex, right rear section, right shoulder portion and right front section of the base strap.

10. The wearable visibility system of claim 9, further comprising a belt attached to the front apex and the rear apex of the base strap.

11. The wearable visibility system of claim 10 wherein the belt has a quick-release buckle.

* * * * *